US005582270A

United States Patent [19]

Fowler

[11] Patent Number: 5,582,270

[45] Date of Patent: Dec. 10, 1996

[54] EXTENSION LADDER PULLEY SYSTEM

[76] Inventor: Robert N. Fowler, 178 Broad Ave., Leonia, N.J. 07605-2015

[21] Appl. No.: 350,680

[22] Filed: Dec. 7, 1994

[51] Int. Cl.[6] ..... E06C 7/00

[52] U.S. Cl. ..... 182/203; 182/228

[58] Field of Search ..... 182/208, 207, 182/209–213, 228, 195

[56] References Cited

U.S. PATENT DOCUMENTS

| | | | |
|---|---|---|---|
| 470,515 | 3/1892 | Skeels | 182/209 |
| 659,667 | 10/1900 | Harmon et al. | 182/208 |
| 1,101,359 | 6/1914 | Thompson | 182/228 X |
| 1,582,793 | 4/1926 | Smith et al. | 182/228 X |
| 1,651,478 | 12/1927 | Skeels | 182/213 |
| 2,265,735 | 12/1941 | Lambert | 182/228 |
| 2,989,141 | 6/1961 | Howard | 182/228 X |
| 3,208,554 | 9/1965 | Arnold | 182/228 X |
| 3,369,630 | 2/1968 | Rich | 182/228 X |
| 3,495,684 | 2/1970 | Homery | 182/228 X |
| 3,935,926 | 2/1976 | Butler | 182/210 X |

*Primary Examiner*—Karen J. Chotkowski
*Attorney, Agent, or Firm*—Terrance L. Siemens

[57] ABSTRACT

An improved replacement ladder rung/pulley construction is disclosed wherein a rotatable rod, mounted on bearings and extending substantially completely from one side of the ladder wall to the other, is located within the rung. The rung has a cutout portion proximate its center, which allows a rope to be passed therethrough and over the rotatable rod. The rod thus functions as a pulley and obviates the possibility of the rope sliding off and becoming jammed if the pulling force is exerted from one side or the other.

2 Claims, 2 Drawing Sheets

EXTENSION LADDER PULLEY SYSTEM

BACKGROUND OF THE INVENTION

1. Field of the Invention

The present invention relates to extension ladders. More specifically, it relates to a replacement rung for an extension ladder. Even more specifically, it relates to a replacement rung that serves to replace the existing pulley on an extension ladder by providing an internally mounted rod within the rung. The rod is mounted on bearings that allow it to spin freely about its long axis. Additionally, the present invention includes a notch or cutout in the replacement rung to allow the rope to be passed over the rotatable rod. More generally, the present invention would serve in any application wherein the rope may inadvertently be dislodged or become jammed against the pulley and a replacement for the pulley is desired.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Extension ladders are well known devices and have been used for many years to allow for efficient storage and portability. In the most common of these types of ladders, the extension is accomplished by fixing one end of a cord to a rung proximate the bottom of the ladder section that will move in relation to the other and run the cord through a pulley proximate the top of the fixed ladder segment. Thus, the user can pull the cord to propel the movable ladder segment upwards. One of the disadvantages of this type of arrangement is that the cord or rope can slip off of the pulley and become jammed. This likelihood increases if the force is applied sideways. The present invention addresses this problem by providing a rotating rod within the ladder rung that extends substantially from one side of the ladder to the other. Thus, the rope is free to slide from side to side while the user is pulling on it to extend the movable ladder portion. A number of patents have been issued that relate to this invention and they are discussed hereinafter:

First is U.S. Pat. No. 190,085 issued to Obadiah Sherwood, Jr. on Apr. 24, 1877. This discloses a fire escape wherein a pair of ropes and a pair of pulleys are used to extend the ladder segments. This is dissimilar from the present invention in that a grooved pulley is specified and no teaching of a smooth rotating rod extending substantially from one side of the ladder to the other is disclosed.

U.S. Pat. No. 333,784 issued to John Royds on Jan. 5, 1886 discloses an extension ladder. Unlike the present invention, there is no teaching of the smooth bar rotatable within a ladder rung and extending across the width of the ladder to serve as a pulley. The pulleys seen in the Royds disclosure are decidedly concave in their rope receiving areas.

Next is U.S. Pat. No. 843,989 issued to Martin Bauer on Feb. 12, 1907. This discloses a combined ladder and scaffold. An extending portion of the ladder is shown, however, no rope or pulley means for the extension thereof is disclosed.

In U.S. Pat. No. 1,912,331 issued to Anders Wikstrand on May 30, 1933 there is disclosed a ladder like structure wherein overlapping sections and locking means between the same are provided for ease of transportation. This invention shows the rope passed over one of the ladder rungs, however the specification states that the rungs are so fastened to the walls of the ladder that the turning of the rungs is prevented. This, in addition to the fact that no rope carrying member is taught being disposed within the rung itself with a cutout for access thereto, make Wikstrand clearly dissimilar from the present invention.

U.S. Pat. No. 3,347,340 issued to Harold W. Huska on Oct. 17, 1967 discloses an extension ladder where the fly section is hoisted over the base by an endless cable or rope moving about the outside of, and through two rungs of the base section, and where a depending loop is attached to a bracket on the outside of the fly section. This is clearly unlike the present invention in that no pulley type of structure is shown.

Lastly, U.S. Pat. No. 4,232,761 issued to Reginald C. Philips on Nov. 11, 1980 discloses an extensible ladder. In this device, the rope is wound on a pivotable rung, however in contrast to the present invention, there is no teaching of an internally located rotatable rod for serving as a pulley in the device.

None of the above inventions and patents, taken either singly or in combination, is seen to describe the instant invention as claimed.

SUMMARY OF THE INVENTION

Briefly, the invention comprises an improved replacement ladder rung construction wherein a rotatable rod, mounted on bearings and extending substantially completely from one side of the ladder wall to the other, is located within the rung. The rung has a cutout portion proximate its center, which allows a rope to be passed therethrough and over the rotatable rod. The rod thus functions as a pulley and obviates the possibility of the rope sliding off and becoming jammed if the pulling force is exerted from one side or the other.

Accordingly, it is a principal object of the invention to provide a new and improved ladder replacement rung which overcomes the disadvantages of the prior art in a simple but effective manner.

It is a major object of this invention to provide a replacement rung that serves to replace the standard pulley assembly on an extension ladder.

It is another object of the invention to provide a replacement rung that has a smooth rotatable rod extending therethrough to serve as the pulley without the possibility of the rope slipping off and becoming jammed.

It is another object of the invention to provide a replacement rung that has a cutout portion located proximate the center thereof, to allow access for the rope to be passed over the rod.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
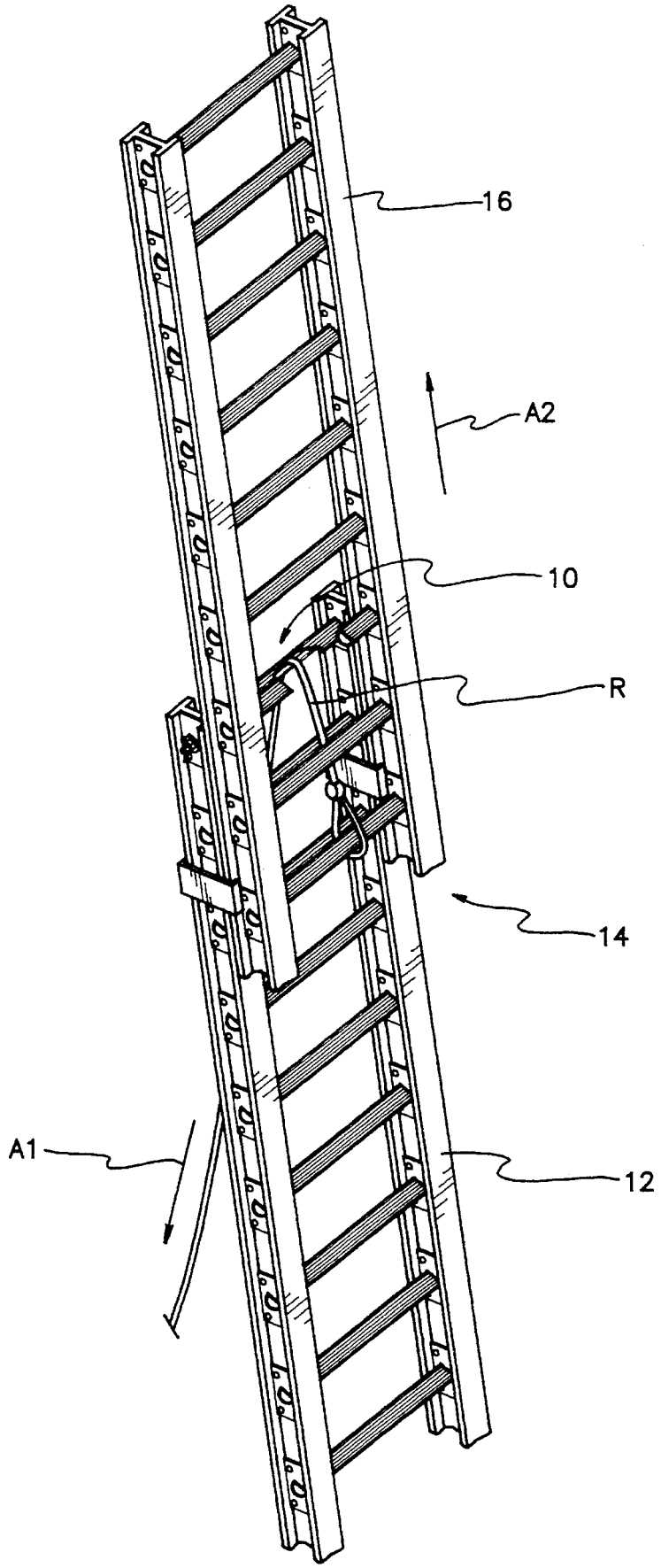
FIG. 1 is an environmental perspective view of an extension ladder with the replacement rung in use and having one of the rungs in the movable portion of the ladder cut away to more clearly see the replacement rung..
Figure 2:
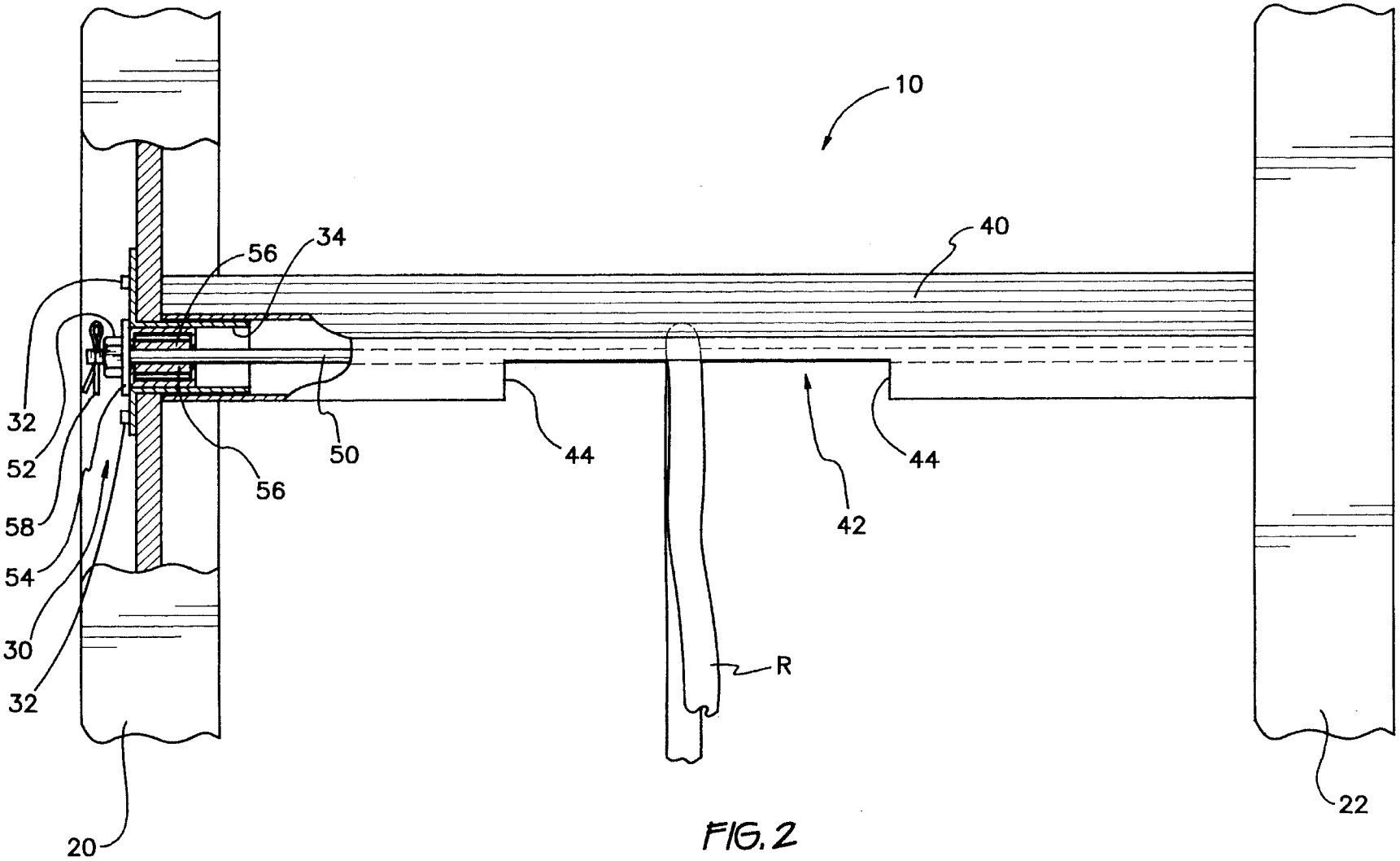
FIG. 2 is a partial cutaway view of the replacement rung for an extension ladder showing the bearings and attachment means for the rotating rod.

The present invention is indicated generally in FIGS. 1 and 2 at 10. Referring to FIG. 1, the replacement rung 10 is preferably placed near the top of the base section 12 of the extension ladder 14. The movable section 16 of the ladder 14 slidably engaged with the base section 12, as is known in the ladder art. With the replacement rung 10 thus located, a rope R is moved in the direction of arrow A1 and the movable extension 16 is pulled in the direction indicated by A2. The means by which the two sections 12, 16 are held in relation to one another and the latching or locking means that keep the movable section 16 in the extended position are well known in the art and will not be discussed.

Referring now to FIG. 2, the details of the replacement rung will now be discussed. The rung 10 is inserted into the side rails 20, 22 of the base portion 12 of the ladder 14. The sidewall engagement portions 30 of the rung 10 are attached to the side walls 20, 22 of the ladder 14. Only one of the sidewall engagement portions 30 is shown in FIG. 2, however it should be understood that the other is substantially a mirror image thereof. The sidewall engagement portions 30 are attached by threaded engagement means 32, or some other appropriate attachment means to securely fix the engagement portions 30 in relation to the side walls 20, 22. First, one of the sidewall engagement portions 30 would be attached to one of the side walls 20, 22 and then the central, hollow rung portion 40 would be placed over the inwardly protruding rung engagement portion 34, as seen in FIG. 2. The other sidewall engagement portion would then be inserted and fixed in place on the remaining ladder sidewall. The rotatable rod 50 is now inserted. The rod 50 is threaded at either of its distal ends to receive nut 52 and washer 54. As mentioned above, though only one set of washers and nuts is shown in FIG. 2, it should be clearly understood that the other sidewall is substantially a mirror image. The rod 50 after being inserted, is free to ride on bearing or carriage means 56. Bearing or carriage means 56 conventionally constrain the borne element, this being rod 50, against radial movement with respect to the longitudinal axis of rod 50 while enabling free rotation therein. A cotter pin 58 is placed though the each of the ends of the rod 50 to further secure it in place. Thus when the rod 50 rotates as the rope R passes over it, so do the washers 54, the nuts 52, and the cotter pins 58. The slot 42 in the central rung portion 40 is downwardly open, and allows access to the rod 50 so that the user of the device can pass the rope R thereover. The edges 44 of the slot 42 would preferably be smooth or could be beaded with a polymer or like substance to reduce wear and friction as the rope is moved.

Thus the present invention allows for extending the ladder and reduces or eliminates the possibility of the rope slipping off of the pulley since the rod 50 serving as the pulley has no concavities or rope guides thereon and the only limit to the side to side motion of the rope are the edges 44 of the slot 42.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. It is to be understood that the present invention is not limited to the sole embodiment described above, but encompasses any and all embodiments within the scope of the following claims:

I claim:

1. A replacement rung and pulley for an existing or new manufactured extension ladder, where the ladder includes a base section, a movable section slidably attached to the base section, and a pair of side rails on both the base section and movable section, said replacement rung and pulley comprising side rail attachment means for attaching said replacement rung and pulley to the side rails of the base section of the ladder;

a central rung portion having a longitudinal axis extending from one side rail to the other side rail of the base section of the ladder, said central rung portion being substantially hollow and including means defining a slot formed in said central rung portion and opening downwardly therefrom;

a smooth cylindrical rod having a longitudinal axis disposed within said central rung portion, said rod being disposed generally parallel to said longitudinal axis of said central rung portion, carriage means rigidly attaching said replacement rung to the side rails of the base section of the ladder including rotational bearing means enabling free rotation of said rod within said central rung portion about its longitudinal axis and constraining said rod against radial movement with respect to its longitudinal axis; whereby when said replacement rung is attached to the side rails of the base section of the ladder, a rope may be passed through said slot in said central rung portion and over said rod and attached to the movable section of the ladder, and said rod thereby subsequently rotates as a pulley without the risk of the rope becoming jammed if pulled from the side.

2. An extension ladder having a pulley for operating a rope employed to raise the extension, said ladder comprising:

a base section having a right side rail, a left side rail, a plurality of rungs extending between said right side rail and said left side rail, and pulley means attached to said base section, said pulley means comprising a hollow rung extending between said said right side rail and said left side rail, said hollow rung having means defining a downwardly open slot, a smooth, cylindrical rod having a longitudinal axis, support means for supporting said rod in a position within and substantially parallel to said hollow rung, and for maintaining said rod in place within said hollow rung, and carriage means enabling free rotation of said rod about said longitudinal axis and constraining said rod against radial motion with respect to said longitudinal axis;

a movable section having a second right side rail, a second left side rail, and a plurality of second rungs extending between said second right side rail and said second left side rail;

a rope attached to said movable section of said extension ladder, said rope extending to passing through said slot of said hollow rung, and passing over said rod, whereby said rope is prevented from jamming on a pulley when a pulling force is exerted from the side of said extension ladder.

* * * * *